US006575841B1

(12) United States Patent
Erdoes et al.

(10) Patent No.: US 6,575,841 B1
(45) Date of Patent: Jun. 10, 2003

(54) GOLFING GAME WITH UNDULATING SURFACE

(76) Inventors: Brenda Erdoes, 1015 Jeanell Dr., Carson City, NV (US) 89703; Jeff Erdoes, 1015 Jeanell Dr., Carson City, NV (US) 89703

( * ) Notice: Subject to any disclaimer, the term of this patent is extended or adjusted under 35 U.S.C. 154(b) by 583 days.

(21) Appl. No.: 09/285,607

(22) Filed: Apr. 2, 1999

Related U.S. Application Data

(60) Division of application No. 08/978,101, filed on Nov. 25, 1997, now Pat. No. 6,196,929, and a continuation-in-part of application No. 08/132,188, filed on Oct. 6, 1993.

(51) Int. Cl.[7] ..... A63B 69/36
(52) U.S. Cl. ..... 473/160; 176/162

(58) Field of Search ..... 473/160, 161, 473/175, 162, 176

(56) References Cited

U.S. PATENT DOCUMENTS 3,595,581 A * 7/1971 Anderson ..... 473/161
3,601,407 A * 8/1971 Lorrance ..... 473/180
4,273,329 A * 6/1981 Trigg et al. ..... 473/176

* cited by examiner

*Primary Examiner*—Mark S. Graham
(74) *Attorney, Agent, or Firm*—Herbert C. Schulze

(57) ABSTRACT

A golf based game including chipping and putting practice utilizing interlocking mats, unique scoring method and device with provisions for making variable undulations or irregularities on a simulated putting surface.

1 Claim, 4 Drawing Sheets

GOLFING GAME WITH UNDULATING SURFACE

CROSS REFERENCE TO RELATED PATENT APPLICATIONS

This invention is related to, and is a continuation in part of our co-pending application for Golfing Game, Ser. No. 08/132,188 filed Oct. 6, 1993, now pending, and is a divisional application of our co-pending application for Golfing Game With Undulating Surface Ser. No. 08/978, 101, filed Nov. 25, 1997, now U.S. Pat. No. 6,196,429.

BACKGROUND OF THE INVENTION

I. Field of the Invention

This invention is in the general field of games;

The invention is more particularly directed to a golfing type game;

The invention is even more particularly directed to a game which involves the use of chipping and putting portions of a golf game including means and method for causing minor undulations or variations of the surface, such as will usually be found on regular golfing turfs and putting greens.

II. Description of the Prior Art

There have been many games of various types involving golf. Such games have included special putting games and certain long full scale driving games and the like.

The present game involves a combination of short chipping golf shots and putting on simulated golf course and golf green material which may be used either indoors or outdoors. The game involves unique scoring and scoring counters. This game now includes unique and unusual means and methods for imparting undulating or irregular minor variations in the otherwise level putting surfaces thus simulating the variations which naturally exist on even the most meticulously groomed golf greens.

We know of no game combining the features of chipping and putting together with a unique scoring arrangement and surface altering feature as in our present invention, and in that sense we know of no prior art which would be applicable to this invention.

SUMMARY OF THE INVENTION

The game of golf id played throughout the world.

Many golfers are unable, either because of time, inclement weather, for reasons of economy, or otherwise, to play on a golf course as often as they would desire. At the same time such golfers do wish to practice in a convenient and economical manner. Such golfers particularly like the competitiveness of competing against other in their practice.

Two extremely important aspects of the game of golf are chipping and putting.

In order to make chip shots and in order to putt, it is generally necessary to have actual golf course conditions in order to practice of simulate the shots effectively. Most persons do not have such facilities at their home, and particularly within the home.

We have now devised a game which makes it possible to have proper competitive practice in the areas of chipping and putting. We have accomplished this by providing a series of mats of a material which closely simulates the reaction of golf course conditions, and particularly the putting green.

We have studied artificial golf green materials and have looked at miniature golf facilities, putting mats and the like.

We have compared our observations of such materials with our observations of actual putting greens. We have discovered that many of the artificial mats closely simulate the actual putting greens on golf courses, with one exception. That exception is that on actual golf course putting greens, no matter how level, there are very small undulations or irregularities on the surface due to many causes, including the effect of persons walking on the surface, balls hitting the surface after an approach shot, and the like.

We have now conceived and developed a means and method for simulating the minor undulations and irregularities of natural putting green surfaces. We do this by preparing a grid on the bottom of the putting mats and inserting a number of small pegs into the grid pattern in such manner that we create the minor undulations and irregularities found on actual golf course putting greens.

By the use our special mats a golfer can take short chip shots from, or adjacent to, one mat, or another location, to one or more mats simulating sloping or level greens. The golfer can then putt on such simulated green until the ball falls into a hole simulating the golf green cup.

We have devised a unique scoring system for use with this game including scoring devices which can be used to accurately measure positions of balls on the mats and to provide a unique scoring arrangement.

We have, also, provided a unique score keeping mechanism.

It is an object of this invention to provide an entertaining game during the play of which golfers may practice shipping and putting;

Another object of this invention is to provide such a game wherein the game may be played indoors or outdoors;

A further object of this invention is to provide a game as described wherein the game may be played over different lengths of a simulated portion of a golf course;

Still another object of this invention is to provide an artificial golf putting green surface have irregularities or undulations similar to those found on a natural golf course putting green.

The foregoing and other objects and advantages of this invention will become apparent to those skilled in the art upon reading the description of a preferred embodiment which follows in conjunction with a review of the appended drawings.

DESCRIPTION OF A PREFERRED EMBODIMENT

Figure 1:
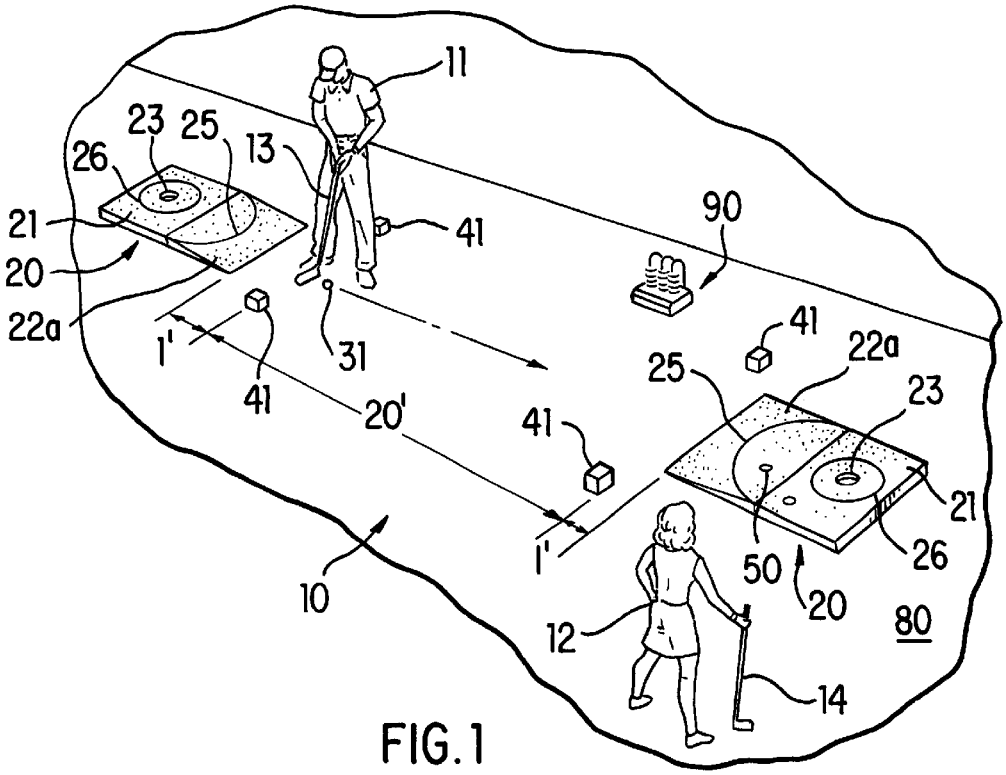
FIG. 1 is a perspective showing the game of this invention being played.

In FIG. 1, two players 11 and 12 are playing the putting game on a putting game layout generally 10. Each of the two players has a putter 13 and 14 respectively. There are two sets of putting mats 20 at a distance from each other as shown. Each mat consisting of two sections 21 and 22*a*. Putting mats 21 have a hole 23 the appropriate size for a putting green hole in an actual game of golf. Although not shown, there is a scoring measure device which is illustrated as 55 in FIG. 9.

The player 11 is shown putting ball 31 toward the simulated putting green 20 at the right side of FIG. 1. Ball markers 50 as will be described hereinafter are shown in place on the putting area at which the ball is aimed, The player 11 is putting from between two line markers 41. The line markers 41 at the other end will be used in the returning play from between those line markers to the putting area at the left side of FIG. 1.

Scoring device 90 is illustrated and will be described in more detail below.

Figure 2:
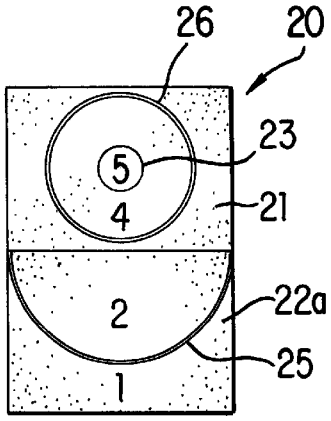
FIG. 2 is a top elevation illustrating the putting scoring arrangement on the putting mats.

The putting scoring arrangement for this game is illustrated in FIG. 2. A putting pad 21–22*a* is illustrated showing a score marking circle 25 and another score marking circle 26. The hole 23 is illustrated. A ball in the hole scores five points. A ball withing the ring 26 will score four points. A ball within the half circle 25 will score two points. And a ball on the mat in the area marked 1 outside of the circle 25 will score one point.

Likewise, the same arrangement will be for the chipping game except there is an additional marker number 3 on intermediate mat 22. These assigned figures are for purposes of illustration of one way in which the game might be played. However, it is to be understood that this is not a limitation and the game could be played without any particular assignment of values other than taking a number of strokes to get the ball into the hole in each case.

Figure 4:
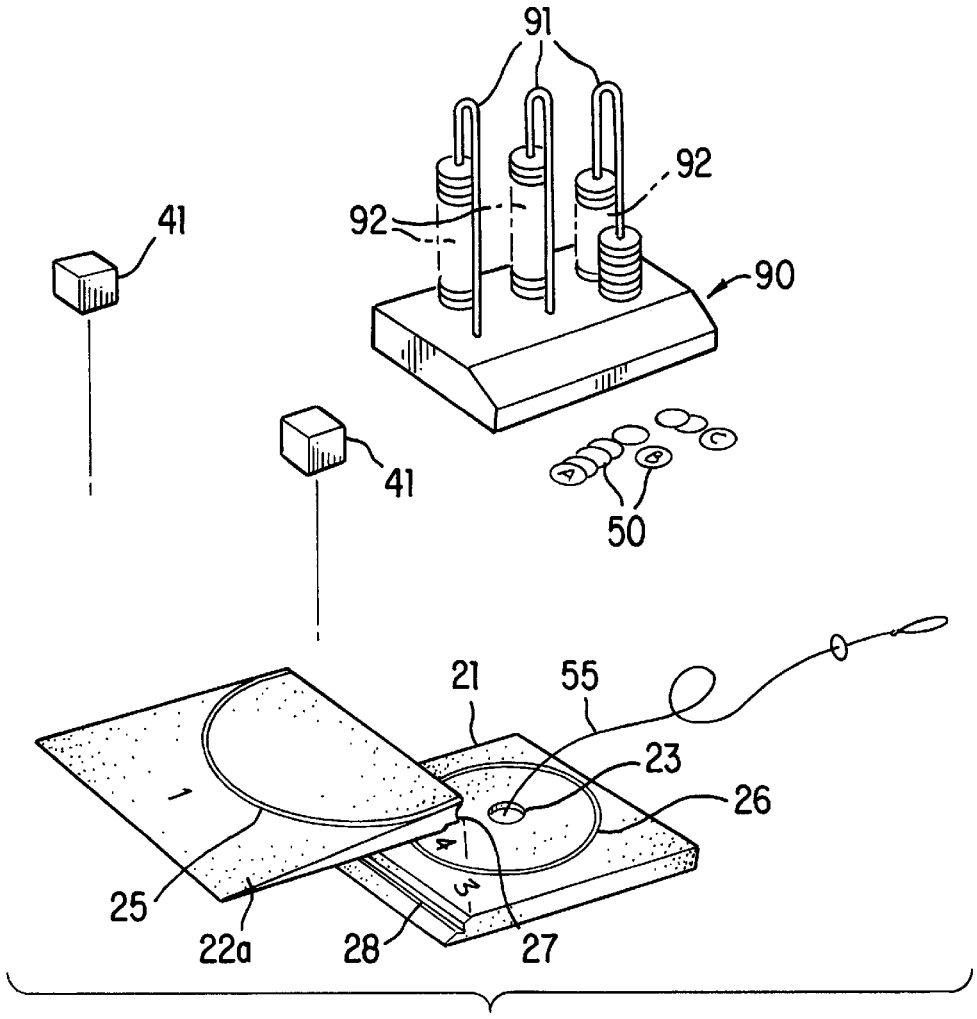
FIG. 4 is a perspective with a portion exploded showing the complete putting game assembly including the scoring counter and tee markers.

FIG. 4 shows all of the elements required for playing the putting game (except for use of the irregularities or undulations described in connection with FIGS. 11 through 14). There are the two sets of mats 21 and 22*a* which interlock with each other as illustrated by the tab 27 and groove 28. There are the t-blocks 41 and ball markers 50. There is also the measuring cord 55. The ball markers are primarily for purposes only of determining the initial starting order. To determine the starting order, each player in turn takes one shot and then marks the position of his ball so there will be no interference with the next person. The one achieving the highest score, or the closest position with relation to the cup starts first and so on. Also if desired the markers may be used for the purpose of removing a ball from the position at which it has come to rest and having a ball marker either identified with a letter or by color or otherwise indicating which ball marker will be assigned to a particular player. Thus, after one player has completed a putt he may put down the ball marker and pick up the ball so the ball will not be in a position to interfere with or be moved by the next putt.

With the explanation given above, it should be understood that the most preferable play of this game is to not use the ball markers except for determining the order of play. The reason for this is that when a ball, or balls, are on the playing area the next player in turn has the opportunity to knock the ball off of the mat or out of play by hitting the ball of a previous player with his own ball. This applies, also, to a ball already in the cup. The cup is purposely shallow so that a ball in the cup may be knocked out of the cup. This imparts considerable excitement to the game. The scoring device 90 consists of a base upon which are mounted inverted U-shaped rods 91 having a number of individual disks 92 which can be moved over the U to indicate the scoring of any particular player or groups of players.

Figure 5:
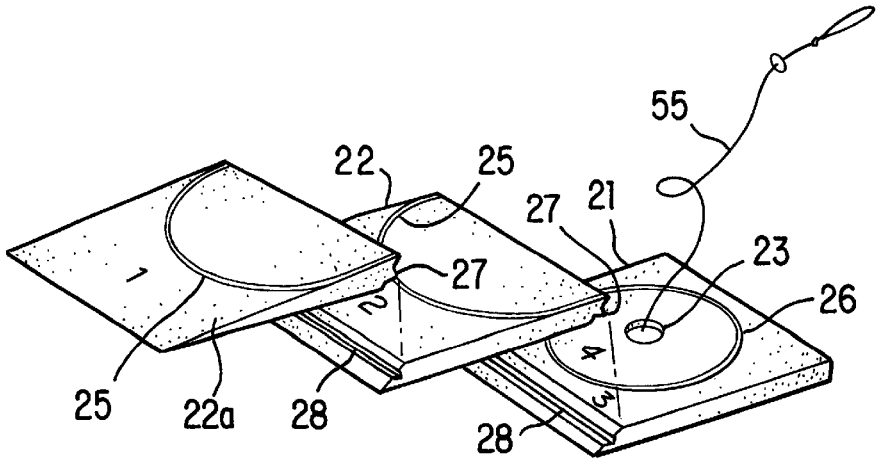
FIG. 5 is an exploded view of the chipping game mats.

FIG. 5 illustrates the chipping game mat. The chipping can be made from one chipping game mat to another, laid out in essentially the same manner as the putting game shown in FIG. 1. The ball may be chipped from one mat to another or may be chipped from some other surface upon which the mat rests.

Figure 6:
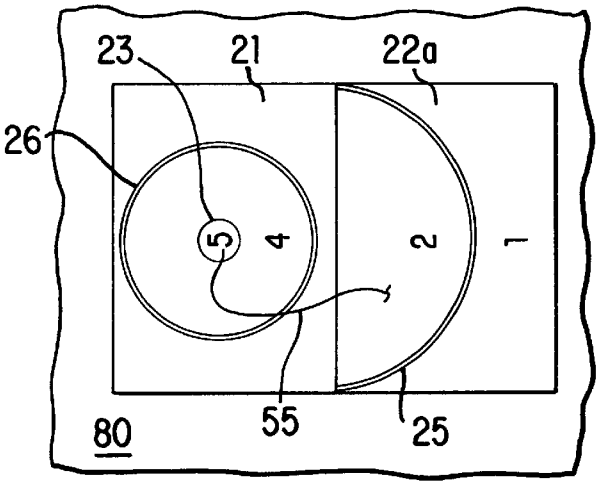
FIG. 6 illustrates a putting mat assembly.

FIG. 6 is a plan view of the putting mats 21–22*a* joined together showing the elements already described and in addition the scoring cord 55. The mats resting upon a ground surface or a carpet surface or any suitable surface 80. The cord is attached within the hole 23.

Figure 7:
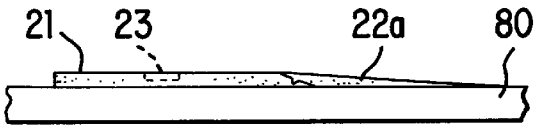
FIG. 7 is a side elevation of the putting mat assembly.

FIG. 7 is a side elevation of the mats.

Figure 8:
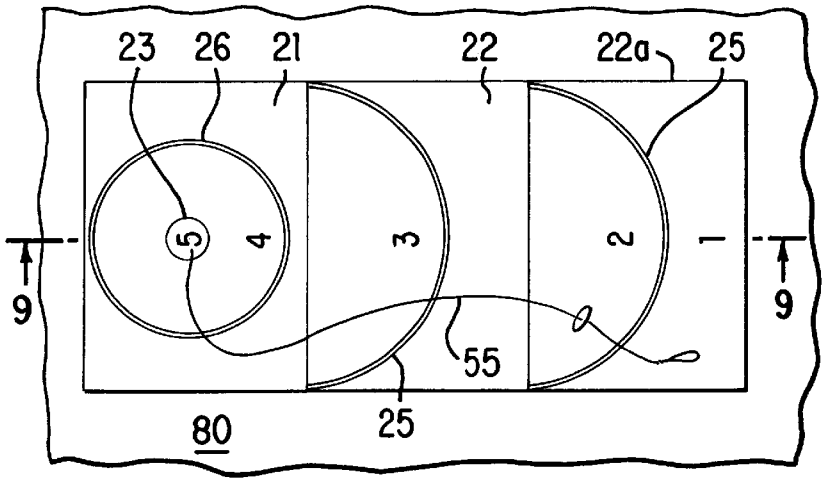
FIG. 8 is a plan of the chipping mat assembly.
Figure 9:
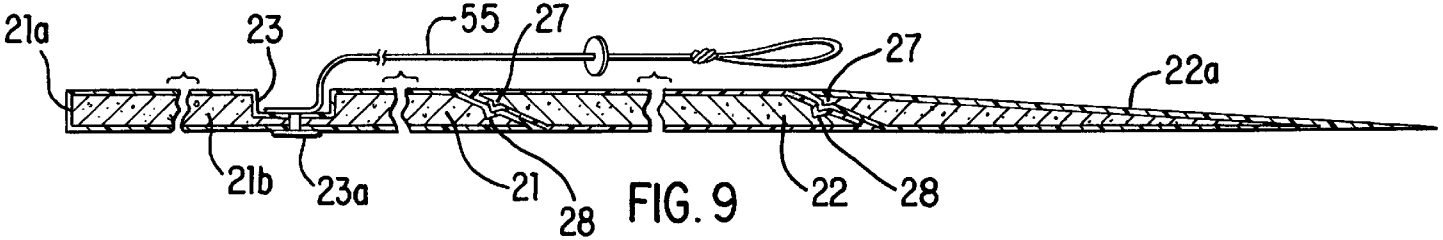
FIG. 9 is a section through 9—9 of the chipping mat assembly in an enlarged scale.
Figure 10:
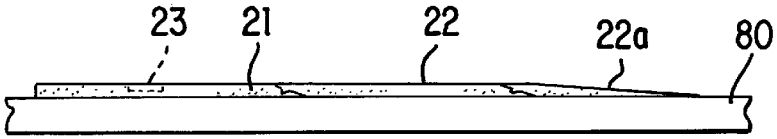
FIG. 10 is a side elevation of the chipping mat assembly on a surface.

FIGS. 8, 9, and 10 show the chipping mat which is the same as the putting mats except that there is an intermediate section 22 which elongates the chipping mat as compared to the putting mat alone.

Figure 11:
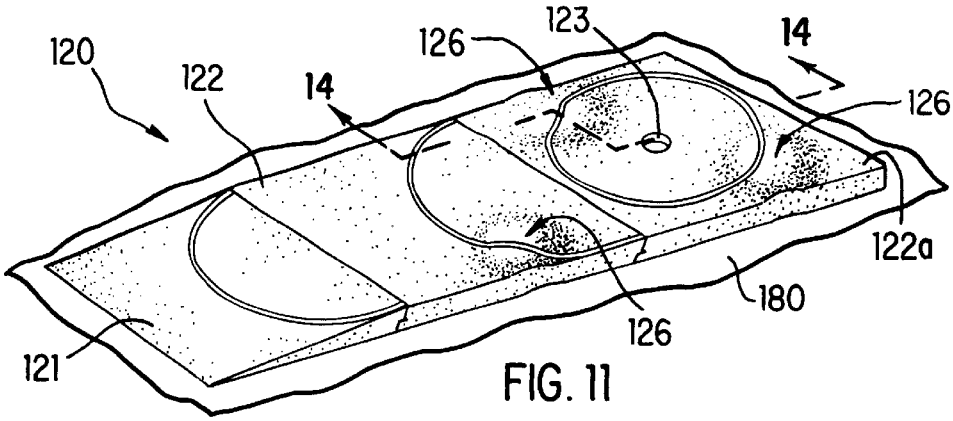
FIG. 11 is a perspective of the mat assembly illustrating irregularities or undulations on the surface of the mats.

FIG. 11 is a perspective of an alternate series of pads similar to those shown in previous illustrations resting on a base surface 180. In this case, pad 121 is similar to 22*a* of FIG. 3, pad 122 is similar to pad 22 of FIG. 3, and pad 122*a* is similar to pad 21 of FIG. 3. In FIG. 11, the cup 123 is the equivalent of the cup 23 in FIG. 3. However, instead of the upper surface of pads 122 and 122*a* being smooth as in figure pads 21 and 22 of FIG. 3, there are irregularities, or undulations at areas 126 in the illustration of FIG. 11.

Figure 12:
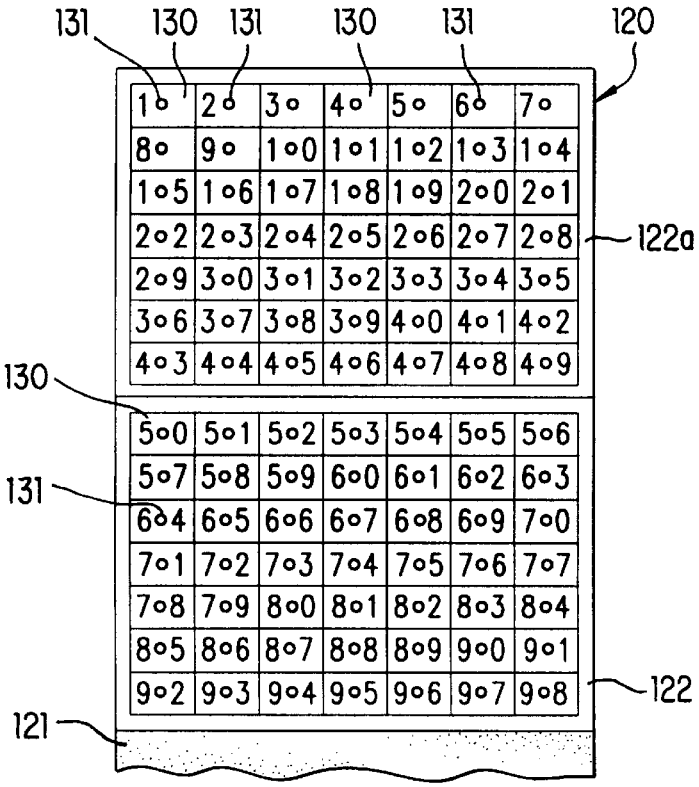
FIG. 12 is a bottom plan of putting mats showing a grid marking.

FIG. 12 is the bottom plan of the mats 122 and 122*a*, the two mats together being referred to generally as 120. The pads will preferably have the grids as indicated and numbered. Each numbered grid space grid space 130 will have a small hole 131 drilled in the center. Assuming a mat thickness of about one half inch, each hole will preferably be about one quarter to three eighths inch deep and about one sixteenth inch diameter. The numbering of the grid spaces is not critical, but is deemed most desirable so that a particular pattern of distortion can be recorded and duplicated when desired.

Figure 13:
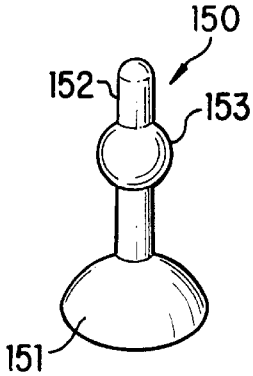
FIG. 13 is an enlarged perspective of a peg used to creating and undulating or irregular top surface of the mats.

FIG. 13 shows a peg generally 150 consisting of a shaft 152 having a rounded top and a donut-like bulge 153 intermediate its ends, and a rounded base 151. Again, assuming a mat thickness of about one half inch, the shaft will preferably be about one sixteenth inch in diameter and about one quarter to three eighths inch in length with the rounded bases 151 preferably in varying sizes to enable varying degrees of distortion to the mat at the locations used. The various sizes indicated are not limiting, and are merely given as some preferred examples.

Figure 14:
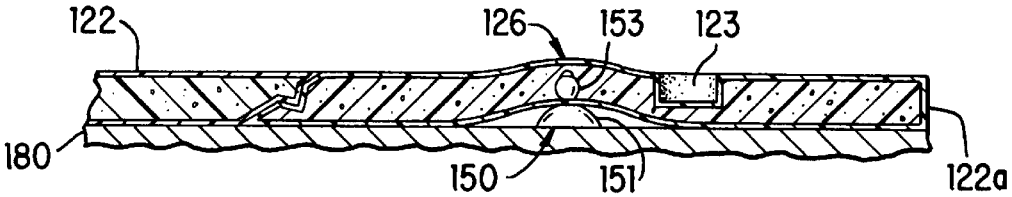
FIG. 14 is a section through 14—14 on FIG. 11.

FIG. 14, the cross section view shows a peg 150 causing one of the distorted areas 126. It can be noted that the bulge 153 will hold the peg in place in the mat.

The measuring cord 55 is shown secured within the hole 23 and it be noted has a sliding disk marker 56. When a ball has been chipped (or putted) to a particular point on the mat, the cord is stretched from the hole when desired to measure its position and the disk 56 can be moved to the location of the particular ball or marker. The cord, with the marker 56 in the first named position can then be moved to the location of another ball or marker and it will be determined that either the two balls or markers are in exactly the same position, or that one is closer to the hole than another. This can be used in connection with a scoring arrangement as will be hereinafter described.

The game may be played in many different ways and even with or without any particular game rules or scoring rules merely for practice.

Figure 3:
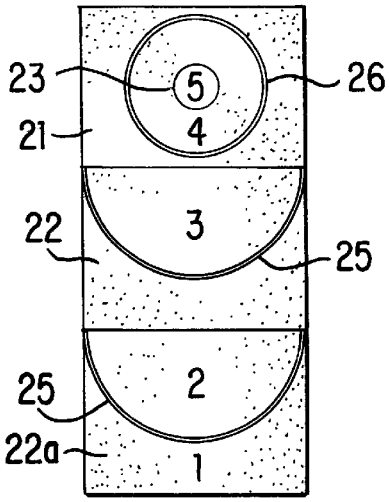
FIG. 3 is a plan elevation showing the chipping scoring arrangement on the chipping mats.

One preferred game involves the goal of the first player, or team of players, to reach a score of 15. Scoring may be determined by the players according to any system they desire. However, it is most desirable in our view that the score of each round be determined by the location of the balls as shown in FIGS. 2 and 3. The ball within the area of numeral 1 could score 1 point; a ball within the area indicated by numeral 2 would score two points; a ball within the area numeral 3 would score three points; a ball within the area numeral 4 would score 4 points; and a ball in the hole would score 5 points.

To determine will chip or putt first at the beginning of a game, normally the players will take one shot each and whoever has the highest score will be the first to start. Normally each player, after first shot, will place his marker on the pad so that other players will have an equal opportunity to achieve the closest goal without interfering with the other players ball. Any other determination such as the flip of a coin or anything else may be used for the starting order.

The markers are normally used only for this purpose. In this manner, after the balls are once on position, any ball can be knocked out of position, or out of the hole, which is small and whole, by another player putting his ball into that hole and knocking the other player out. This creates additional aggressive playing.

After each round, the player, or team which has the highest score for that particular round will be the one to have the advantage of being the last to play the next round. In order to attempt to avoid the continued advantage, however, the players, or teams, may alternate for each round or the lowest score may be allowed to go last on the next succeeding round.

The unique scoring device 90 has been provided so as to allow the players to be able to record their score by moving the colored markers 92 on the wire holder so as to accumulate the score by moving the markers from one position to another.

While the embodiment of this invention shown and described as fully capable of achieving the objects and advantages desired, it is to be understood that this embodiment is for purposes of illustration only and not for purposes of limitation.

We claim:

1. A mat for simulated golf putting comprising a sheet of material having a thickness, a top surface approximating the appearance and feel of an actual golf putting green, a bottom surface with at least one hole partially drilled into said mat suitable to receive a peg of solid material for purposes of creating a protrusion on the top surface, a hole in the top surface suitable to receive a golf ball, and an elongate measuring cord affixed within said hole in the top surface suitable to receive a golf ball.

* * * * *